US011380290B2

(12) United States Patent
Ishizaka et al.

(10) Patent No.: US 11,380,290 B2
(45) Date of Patent: Jul. 5, 2022

(54) ELECTRIC GUITAR BODY STRUCTURAL UNIT AND ELECTRIC GUITAR

(71) Applicant: Yamaha Corporation, Hamamatsu (JP)

(72) Inventors: Kenta Ishizaka, Hamamatsu (JP); Hideto Matsuda, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 18 days.

(21) Appl. No.: 17/061,866

(22) Filed: Oct. 2, 2020

(65) Prior Publication Data

US 2021/0264884 A1 Aug. 26, 2021

(30) Foreign Application Priority Data

Nov. 27, 2019 (JP) ..... JP2019-213848

(51) Int. Cl.
*G10D 1/08* (2006.01)

(52) U.S. Cl.
CPC ..... *G10D 1/085* (2013.01)

(58) Field of Classification Search
CPC ..... G10D 1/085; G10D 3/00
See application file for complete search history.

(56) References Cited

U.S. PATENT DOCUMENTS

2005/0284281 A1* 12/2005 Suyama ..... G10D 3/22 84/294

OTHER PUBLICATIONS https://entertainment.ha.com/itm/musical-instruments/electric-guitars/the-kinks-dave-davies-1958-gibson-flying-v-korina-solid-body-electric-guitar-serial-8-4643/a/7213-85040.s?ic16=ViewItem-Auction-Archive-MostPopular-Thumbnail-112917 (Year:Jul. 2019).*

* cited by examiner

*Primary Examiner* — Kimberly R Lockett
(74) *Attorney, Agent, or Firm* — Rossi, Kimms & McDowell LLP

(57) ABSTRACT

A body structural unit for an electric guitar can include a body that includes a wood portion, wherein when viewed from the direction of thickness of the body, the direction of the wood grain of the wood portion is at an angle in respect to the direction of length of the neck of the electric guitar.

14 Claims, 4 Drawing Sheets

ELECTRIC GUITAR BODY STRUCTURAL UNIT AND ELECTRIC GUITAR

BACKGROUND OF THE INVENTIONS

Field of Technology

The present inventions relate to electric guitar bodies and electric guitars generally.

Description of the Related Art

US Patent Application Publication 2005/0284281 discloses an electric guitar comprising a body made from wood. In that electric guitar, the direction of the wood grain of the body matches the lengthwise direction of the neck of the electric guitar.

SUMMARY OF THE INVENTIONS

In electric guitars, vibrations of the strings are transmitted to the body, causing the body to vibrate as well. For an electric guitar to produce good acoustic characteristics, preferably the body as a whole will vibrate with good balance. However, because the shape of the body of many electric guitars is asymmetrical (for example, a shape that is asymmetrical in the direction of width of the body, which is perpendicular to the lengthwise direction of the neck). When the direction of the wood grain matches the lengthwise direction of the neck, as in the guitars of the US 2005/0284281 publication, there will be a larger vibrations in only one part of the body.

In contemplation of the above, an object of at least some of the present inventions is to provide a body structural unit for an electric guitar, and an electric guitar provided therewith, wherein the entirety of the body can vibrate with improved balance, despite being a body of an asymmetrical shape.

In some embodiments, an electric guitar body structural unit can comprise a body that includes a wood portion, wherein, when viewed from the direction of thickness of the body, the direction of the grain of the wood portion is at an angle in respect to the lengthwise direction of the neck of the electric guitar.

In some embodiments, an electric guitar can comprise a neck and a body structural unit as described above.

At least one of the present inventions enables the body as a whole to vibrate with improved balance, despite being a body of an asymmetrical shape.

BRIEF DESCRIPTIONS OF THE DRAWINGS

DETAILED DESCRIPTION OF PREFERRED EMBODIMENTS

Figure 1:
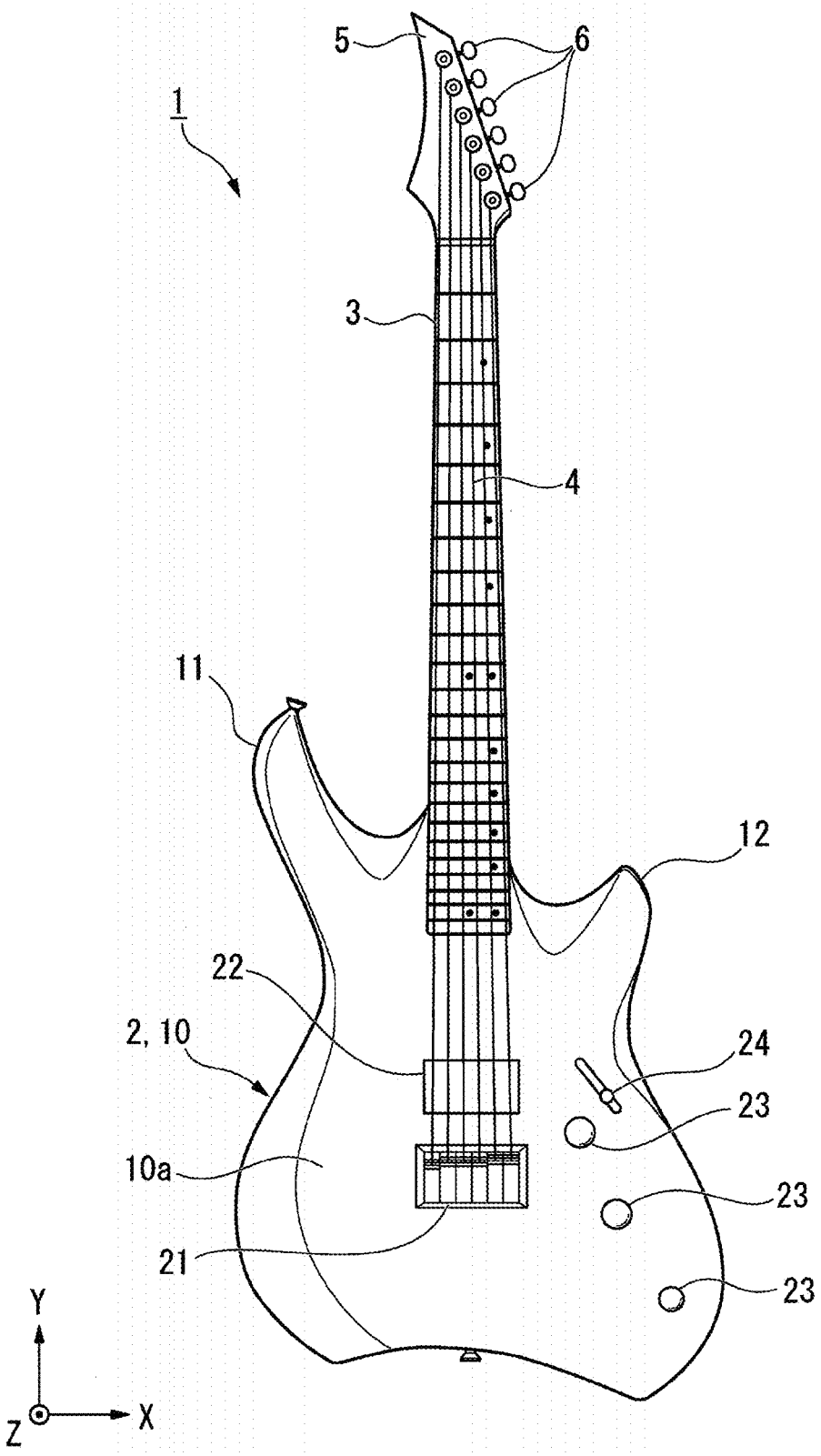
FIG. 1 is a plan view of an electric guitar according to an embodiment, viewed from the front side of the body.

Various embodiments of the inventions disclosed herein are explained below with reference to FIGS. 1 through 4. As illustrated in FIG. 1, an electric guitar 1 according to an embodiment, comprises a body structural unit 2, a neck 3, and strings 4. The neck 3 is connected to an end portion of the body structural unit 2, and extends in a direction away from the body structural unit 2 (the positive Y axial direction). Pegs 6, onto which the end portions of the strings 4 are wound, are provided on a head 5 that forms the tip end portion of the neck 3 in the lengthwise direction (the Y axial direction). The strings 4 are tensioned along the lengthwise direction of the neck 3.

The body structural unit 2 comprises a body 10 that includes a wood portion that is made from wood. In some embodiments, the body 10 forms the entire structure of the body structural unit 2. Moreover, the body 10 can be structured from the wood portion alone. The body 10 is formed in a plate shape. The body 10 may be, for example, a solid body that includes no internal cavity, or may be, for example, a semi-solid body having a cavity (chamber) formed therein in order to reduce the weight.

In the explanation below, there are two directions that are perpendicular to the direction of thickness of the body 10 (the Z axial direction). Those perpendicular directions include the direction of length of the neck 3, defined as the lengthwise direction of the body 10 (the Y axial direction) and the direction that is perpendicular to the thickness direction and lengthwise direction of the body 10, defined as the width direction of the body 10 (the X axial direction).

The connecting part between the body 10 and the neck 3 is positioned, along the lengthwise direction, at a first end portion of the body 10. The connecting part between the body 10 and the neck 3 is also positioned in the middle of the body 10, along the width direction. The dimension of the body 10 in the lengthwise direction, is greater than the dimension of the body 10 in the width direction.

A bridge 21, an electromagnetic pickup 22, a controller (not shown), and the like, are attached to the body 10. The bridge 21, the electromagnetic pickup 22, and the controller are exposed on a surface 10*a*, which faces in the thickness direction of the body 10, on the front side of the body 10. One end of each of the strings 4 is secured to the bridge 21. In the lengthwise direction of the body 10, the electromagnetic pickup 22 is positioned between the neck 3 and the bridge 21. The controller is used to adjust the volume, tone, and the like, of the sound signal that is output from the electromagnetic pickup 22. The controller includes three volume switches 23, a pickup selector 24 for switching the electromagnetic pickup 22 that is activated, and the like.

Figure 2:
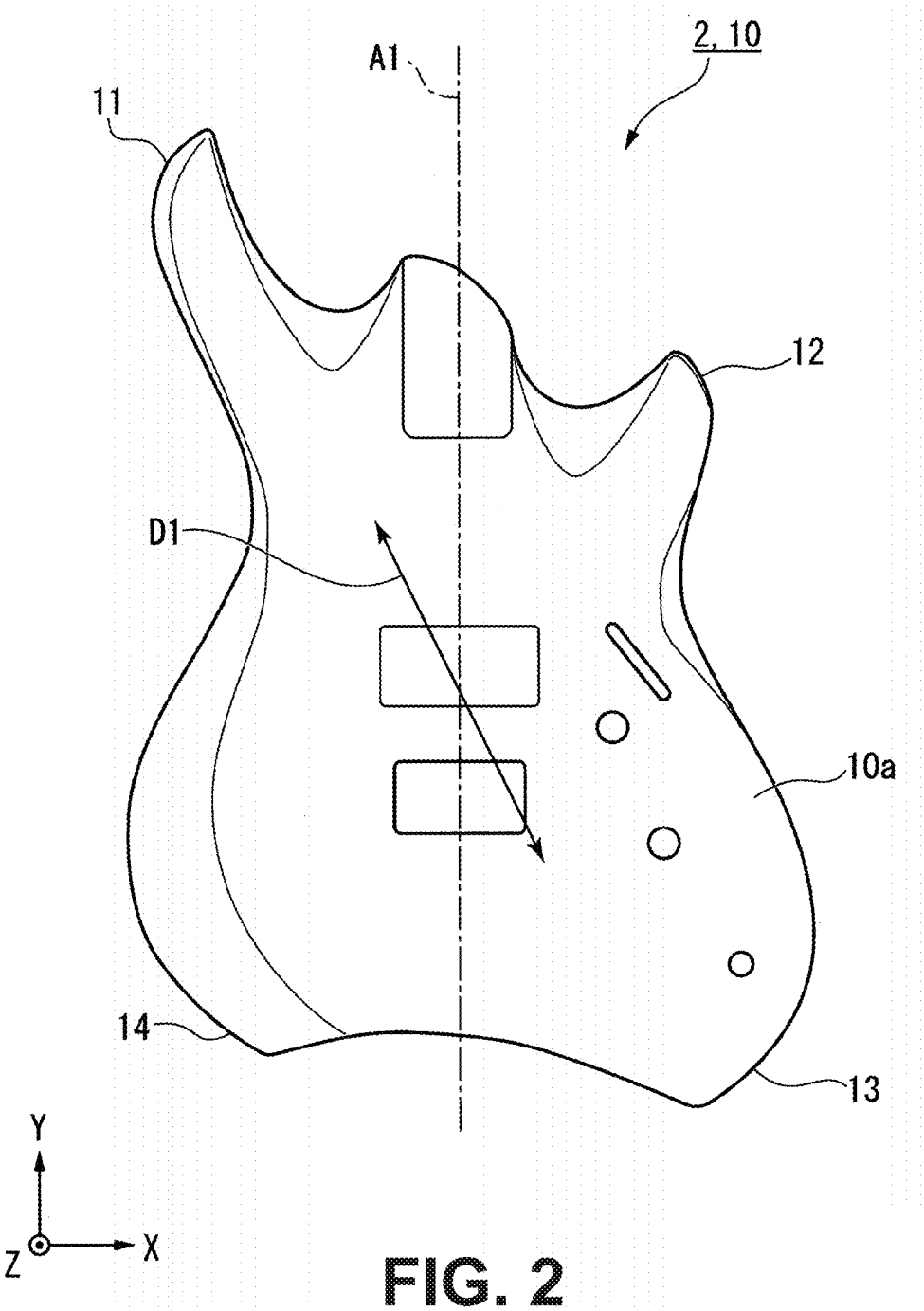
FIG. 2 is a plan view of the body of the electric guitar of FIG. 1, viewed from the front side.

As illustrated in FIG. 2, the body 10, when viewed along the thickness direction, is formed with an asymmetrical shape with respect to a virtual line A1 that extends in the lengthwise direction of the body 10 and through the center of the body 10, in the width direction. The line A1 may instead be a straight line through, for example, the width-direction center of the neck 3.

The asymmetrical shape of the body 10 means that the shape of the body 10 that is positioned on one side, in the width direction of the body 10, with respect to the line A1 (hereinafter termed the "first direction side") is different from the shape of the body 10 that is positioned on the other side, in the width direction of the body 10, with respect to the line A1 (hereinafter termed the "second direction side"). The first direction side is, for example, the side in the positive X axial direction, and the second direction side is, for example, the side in the negative X axial direction. The shape of the body 10, which is asymmetrical, will be explained in greater detail below.

The body 10 has two protruding portions 11 and 12 (a first protruding portion 11 and a second protruding portion 12). Each protruding portion 11 and 12 protrudes in directions that are perpendicular to the thickness direction of the body 10 (directions along the XY plane) with respect to the main part of the body 10 wherein the bridge 21, and the like, are provided. The two protruding portions 11 and 12 are both positioned at a first end portion of the body 10, in the lengthwise-direction. Moreover, the two protruding portions 11 and 12 are positioned at opposite portions along the width direction the body 10. That is, the first protruding portion 11 is positioned on the first direction side (one side of the line A1) and the second protruding portion 12 is positioned on the second direction side (the other side of the line A1). In this way, the two protruding portions 11 and 12 are positioned with a space therebetween in the width direction of the body 10.

The directions of protrusion of each of these protruding portions 11 and 12 are angled away from the lengthwise direction of the body 10, which is the direction in which the neck 3 extends. Specifically, the individual protruding portions 11 and 12 protrude from the body 10, toward the direction in which the neck 3 extends (the positive Y axial direction), and also in directions away from the line A1, in the width direction of the body 10. That is, the two protruding portions 11 and 12 protrude so as to become further away from each other in the width direction of the body 10.

The lengths of protrusion of the two protruding portions 11 and 12 may both be identical. In the present embodiment, the lengths of protrusion of the two protruding portions 11 and 12 are different. Specifically, of the two protruding portions 11 and 12, the length of protrusion of the first protruding portion 11, which is positioned on the left side (the side in the negative X axial direction) with respect to the line A1, may be longer than the length of protrusion of the second protruding portion 12 that is positioned on the right side (the positive X axial direction side). Given this, the body 10 according to the present embodiment is formed in an asymmetrical shape.

Moreover, in the body 10 of the present embodiment, the sizes of the parts of the second end portion of the body 10 (lengthwise direction) may be different on opposite sides of the line A1. For example, of the parts on the second end portion side of the body 10, the part positioned on the right side of the line A1 can be larger than the part positioned on the left side of the line A1. The body 10 according to the present embodiment is formed in an asymmetrical shape due to this point as well. Furthermore, in the body 10 according to the present embodiment, the length of the body 10, when viewed along the thickness direction, is longest in the direction in which the first protruding portion 11 extends (the direction indicated by the arrow D1 in FIG. 2).

When viewed along the thickness direction of the body 10, the direction of the grain of the wood portion of the body 10 is at an angle in respect to the lengthwise direction of the body 10 (the lengthwise direction of the neck 3). Specifically, the direction of the grain of the wood portion of the body 10 extends in the direction wherein the length of the body 10 is the longest (the maximum length direction of the body 10). Moreover, the direction of the grain of the wood portion extends in the direction of protrusion of the first protruding portion 11, which has the longer length of protrusion compared to the second protruding portion 12. The arrow D1 in FIG. 2 indicates the maximum length direction of the body 10, the direction of protrusion of the first protruding portion 11, and the direction of the grain of the wood portion.

As explained above, in the body structural unit 2 and the electric guitar 1 according to the present embodiment, the direction of the grain of the wood portion of the body 10 is at an angle in respect to the lengthwise direction of the body 10. In particular, the direction of the grain of the wood portion extends in the maximum length direction of the body 10 and the direction of protrusion of the first protruding portion 11. Through this, despite the body 10 being formed in an asymmetrical shape, large vibrations being in only one part of the body 10 is prevented, enabling vibration of the body 10 as a whole with good balance. This point will be explained below in reference to FIGS. 3 and 4.

Figure 3:
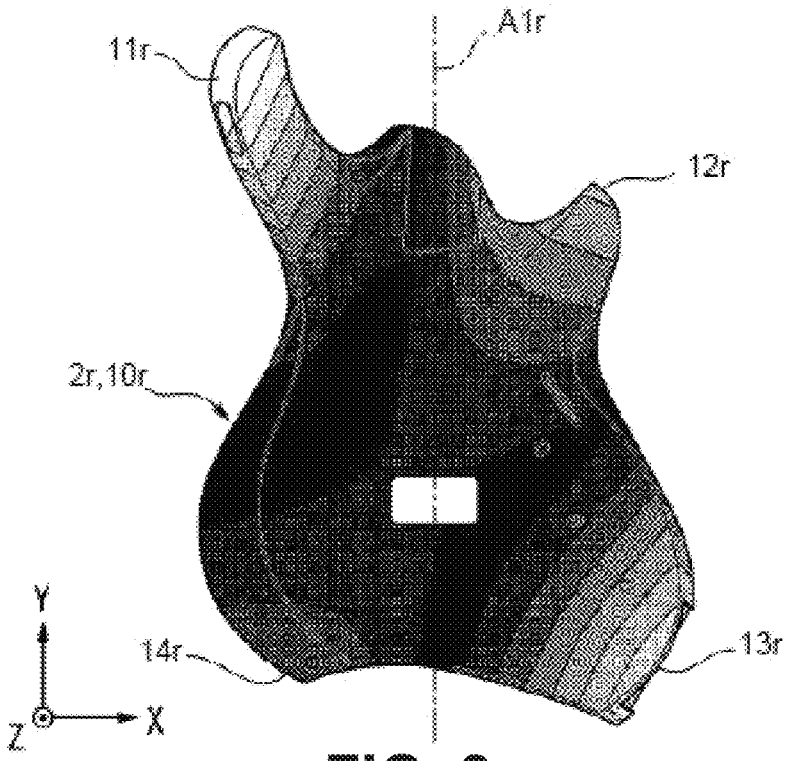
FIG. 3 is a diagram depicting a reference example of a form of vibration of a guitar body.
Figure 4:
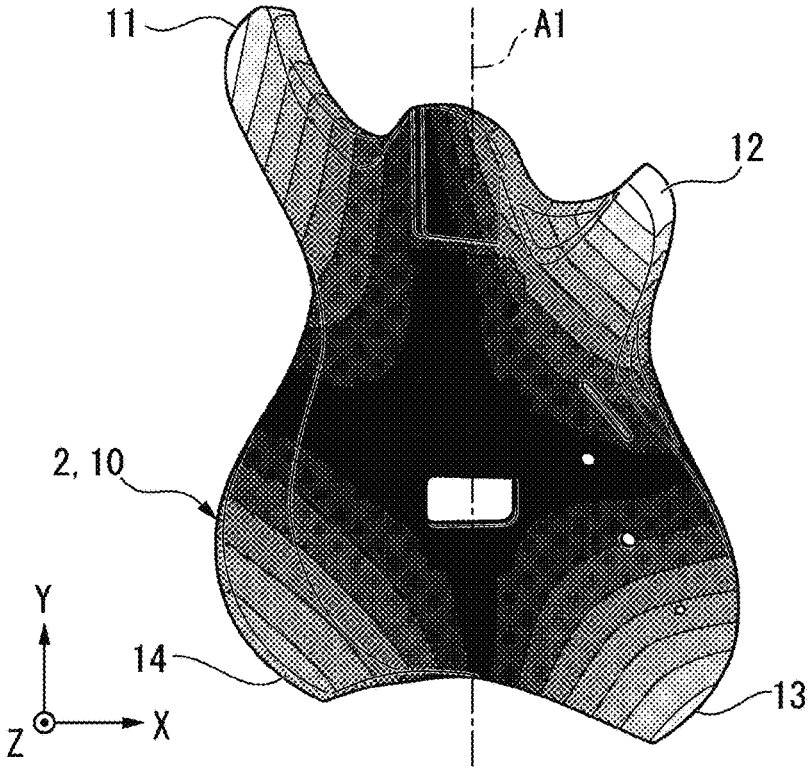
FIG. 4 is a diagram depicting an example of a form of vibration of a guitar body, according to an embodiment.

FIGS. 3 and 4 depict vibration forms wherein a reference body 10*r* (FIG. 3) and the present embodiment of body 10 (FIG. 4) vibrate so as to twist, centered on the line A1*r*, A1 that extends in the lengthwise direction of the body 10. In FIGS. 3 and 4, in the grayscale shading, white indicates a greater amplitude of vibration, and black indicates a lesser amplitude of vibration.

FIG. 3 depicts the vibration of the body 10*r* of a reference example wherein the direction of the grain of the wood portion matches the lengthwise direction of the body 10*r* (the Y axial direction). On the other hand, FIG. 4 depicts the form of vibration of the body 10 according to the present embodiment wherein the direction of the grain of the wood portion extends in the maximum length direction of the body 10, and the direction of protrusion of the first protruding portion 11, which is at an angle in respect to the lengthwise direction of the body 10.

In the form of vibration of the body 10*r*, which is a reference example, depicted in FIG. 3, the amplitude of vibration in the first protruding portion 11*r*, which has a long length of protrusion, is greater than the amplitude of vibration in the second protruding portion 12*r*. Moreover, in second end portion of the body 10*r* (in the lengthwise direction), the amplitude of vibration of the first part 13*r* is greater than the amplitude of vibration in the second part 14*r*. Here, the first part 13*r* is on the same side (in the width direction of the body 10*r*) as the second protruding portion 12*r* with respect to the line A1*r*. In other words, the first part 13*r* is positioned on the side opposite from the first protruding portion 11*r* in the maximum length direction of the body 10*r*. Thus, the amplitude of vibration of the first part 13*r* is greater than the amplitude of vibration in the second part 14*r* that is positioned on the opposite side, in the width direction of the body 10*r*, from the first part 13, with respect to the line A1*r*. Given the above, there is a tendency, in the body 10*r* of the reference example, to have a large vibration at only the first protruding portion 11*r* and the first part 13*r* (at both end portions of the body 10*r* in the maximum length direction). That is, in the body 10*r* of the reference example, vibration is not well-balanced.

In contrast, in the form of vibration of the body 10 of the present embodiment, depicted in FIG. 4, when compared to the reference example depicted in FIG. 3, there is little difference in the amplitude of vibration in the second protruding portion 12 compared to the amplitude of vibration in the first protruding portion 11. Moreover, in the form of vibration of the body 10 of the present embodiment, depicted in FIG. 4, when compared to the reference example depicted in FIG. 3, there is little difference in the amplitude of vibration in the second part 14 compared to the amplitude of vibration in the first part 13 of the body 10. This is due to the vibration of the first protruding portion 11 and the first part 13 being suppressed by the wood portion, through the direction of the grain of the wood portion extending in the direction of protrusion of the first protruding portion 11 and the maximal length direction of the body 10, extending from the first protruding portion 11 to the first part 13. Given the above, the body 10 according to the present embodiment prevents the vibration from being large at only one part of the body 10 (the first protruding portion 11 and the first part 13), enabling the entirety of the body 10 to vibrate with good balance.

While the present inventions are explained in detail above, the present inventions are not limited to the embodiments set forth above, but rather may be modified in a variety of ways in a scope that does not deviate from the spirit or intent of the present inventions.

Figure 5:
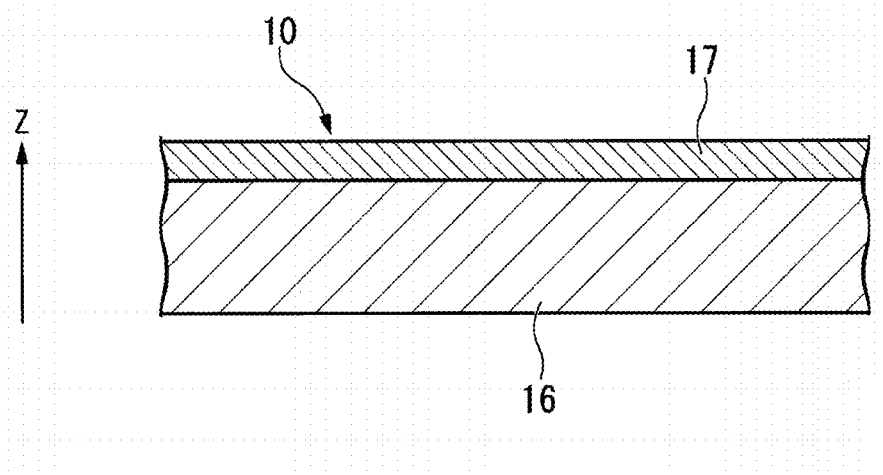
FIG. 5 is a cross-sectional diagram of an electric guitar body, according to another embodiment.

For example, in some embodiments, the wood portion of the body 10 may have a plurality of wood layers 16 and 17 (which, in the illustrated example, is two wood layers), as depicted in FIG. 5. Each of the plurality of wood layers 16 and 17 is formed in a plate shape, and layered together in the thickness direction of the body 10 (the Z axial direction). The thicknesses of the multiple wood layers 16 and 17 may, for example, each be identical, or, as depicted in FIG. 5, may each be different.

In embodiments having multiple wood layers 16 and 17 with different thicknesses, the wood layer 16 that is the thickest, from among the multiple wood layers 16 and 17, may be oriented with the direction of its grain at an angle in respect to the lengthwise direction of the body 10, as in the embodiment set forth above. The wood layer 16 that has the maximal thickness has the greatest effect on the vibration characteristics of the body 10. Because of this, setting the direction of the grain of the wood layer 16 that has the greatest thickness, as described above, can cause the body 10 as a whole to vibrate with good balance.

In embodiments, the body 10 may be provided with another material portion that is made from a material other than wood (for example, a resin material), in addition to the wood portion. In this case, the wood portion and the other material portion would each be formed in, for example, a plate shape, and layered together in the thickness direction of the body 10.

In some embodiments, the number of protruding portions in the body 10 may be, for example, one, or may be three or more. In this case, the one, or three or more, protruding portions may be provided so that the shape of the body 10 is an asymmetrical shape, in the same manner as in the embodiment described above. Moreover, the body 10 may have, for example, no protruding portions.

What is claimed is:

1. A body structural unit for an electric guitar, comprising:

a body that includes a wood portion with a wood grain, wherein a direction of the wood grain of the wood portion, when viewed along a thickness direction of the body, is at an angle with respect to a lengthwise direction of a neck of the electric guitar, wherein the body is formed in an asymmetrical shape with respect to a line that extends in the lengthwise direction through a center in a width direction of the body, and wherein the direction of the wood grain extends in a direction of maximum length of the body, when viewed along the thickness direction.

2. A body structural unit for an electric guitar, comprising:

a body that includes a wood portion with a wood grain, wherein a direction of the wood grain of the wood portion, when viewed along a thickness direction of the body, is at an angle with respect to a lengthwise direction of a neck of the electric guitar, wherein:

the body has a protruding portion; and the direction of the wood grain extends in a direction of protrusion of the protruding portion.

3. The body structural unit for an electric guitar as set forth in claim 1, wherein:

the body has a first protruding portion that is positioned on one side of a straight line that extends in the lengthwise direction through the center in the width direction of the body, and a second protruding portion that is positioned on an other side of the straight line, wherein:

the direction of the wood grain extends in a direction of protrusion of the first protruding portion.

4. The body structural unit for an electric guitar as set forth in claim 3, wherein:

a first length of protrusion of the first protruding portion is longer than a second length of protrusion of the second protruding portion.

5. The body structural unit for an electric guitar as set forth in claim 1, wherein:

the wood portion has a plurality of wood layers of different thicknesses; and the direction of the wood grain of the wood portion is a direction of a wood grain of one layer of the plurality of wood layers that has a greatest thickness, which is at an angle in respect to the lengthwise direction.

6. An electric guitar comprising:

a neck; and the body structural unit as set forth in claim 1.

7. A body of an electric guitar, the body comprising:

a wood portion comprising a wood grain extending along a first wood grain direction and being configured to connect to a guitar neck oriented along a longitudinal neck direction, wherein the first wood grain direction is oriented at an angle offset from the longitudinal neck direction, and wherein the wood portion is formed in an asymmetrical shape with respect to a line that extends in a lengthwise direction of the body, through a center of the body in a width direction of the wood portion, wherein the body comprises a maximum length dimension of the asymmetrical shape of the wood portion and wherein the first wood grain direction extends along the maximum length dimension.

8. The body for an electric guitar as set forth in claim 7, wherein the wood portion comprises a first protruding portion which protrudes along a first protruding direction, and wherein the first wood grain direction extends along the first protruding direction.

9. The body for an electric guitar as set forth in claim 7, wherein the wood portion further comprises:

a first protruding portion which protrudes along a first protruding direction and is positioned on a first side of a straight line that extends in the longitudinal neck direction and through a center of the wood portion in the width direction; and a second protruding portion positioned on a second side of the straight line, wherein the first wood grain direction extends along the first protruding direction of the first protruding portion.

10. The body for an electric guitar as set forth in claim 9, wherein the first protruding portion comprises a first length of protrusion and the second protruding portion comprises a second length of protrusion, wherein the first length of protrusion is longer than the second length of protrusion.

11. The body for an electric guitar as set forth in claim 7, wherein the wood portion comprises a plurality of wood layers including at least a first wood layer having a first wood layer grain direction and a first wood layer thickness that is greater than thicknesses of any other wood layer of the plurality of wood layers, and wherein the first wood layer grain direction is said first wood grain direction.

12. The body for an electric guitar as set forth in claim 7, wherein the wood portion defines a first wood layer of the body, the body further comprising a second wood layer layered with the first wood layer and having a second wood grain direction different than the first wood grain direction, wherein the first wood layer comprises a first thickness and the second wood layer comprises a second thickness, the first thickness being greater than the second thickness.

13. The body for an electric guitar as set forth in claim 7, wherein the wood portion defines a first wood layer of the body, the body further comprising a second layer, wherein the first wood layer comprises a first thickness and the second layer comprises a second thickness, the first thickness being greater than the second thickness.

14. An electric guitar comprising:

a neck; and the body as set forth in claim 7.

* * * * *